United States Patent [19]

Bücker

[11] 4,264,057

[45] Apr. 28, 1981

[54] PROCESS AND DEVICE FOR INCREASING THE USEFUL LIFE OF GAS SCAVENGING LANCES WITH POROUS GRAPHITE FLUSH HEADS

[75] Inventor: Werner Bücker, Düsseldorf, Fed. Rep. of Germany

[73] Assignee: Messer Griesheim, Frankfurt am Main, Fed. Rep. of Germany

[21] Appl. No.: 46,780

[22] Filed: Jun. 8, 1979

[30] Foreign Application Priority Data

Jun. 22, 1978 [DE] Fed. Rep. of Germany ..... 2827403

[51] Int. Cl.[3] ..... C21B 7/10

[52] U.S. Cl. ..... 266/46

[58] Field of Search ..... 266/46, 47, 265, 165

[56] References Cited

U.S. PATENT DOCUMENTS

| | | | |
|---|---|---|---|
| 3,112,194 | 11/1963 | DeVries | 75/60 |
| 3,269,829 | 8/1966 | Belkin | 75/60 |
| 3,304,173 | 2/1967 | Smith | 75/60 |
| 3,330,645 | 7/1967 | DeMoustier | 75/60 |
| 3,932,172 | 1/1976 | Knuppel | 75/60 |

*Primary Examiner*—P. D. Rosenberg

*Attorney, Agent, or Firm*—Connolly and Hutz

[57] ABSTRACT

The useful life is increased of gas scavenging lances having porous graphite flush heads for non-ferrous metal melts by flowing an inert gas, immediately after scavenging, through the lance in a de-energizing cage which surrounds the graphite parts of the lance while forming a narrow gap therewith until a temperature below the ignition temperature of graphite is obtained.

4 Claims, 3 Drawing Figures

PROCESS AND DEVICE FOR INCREASING THE USEFUL LIFE OF GAS SCAVENGING LANCES WITH POROUS GRAPHITE FLUSH HEADS

BACKGROUND OF INVENTION

The invention relates to a process for increasing the useful life of gas scavenging lances with porous graphite flush heads for non-ferrous metal melts. This especially concerns aluminum melts which are scavenged with argon.

The melt is purified, homogenized and degased by scavenging the metal melt with an inert gas. Scavenging is the last treatment phase before pouring the melt. The gas scavenging lance is manually or mechanically lowered in the crucible and the melt is scavenged for about five to ten minutes with an inert gas. The quality of the cast pieces is improved by the scavenging treatment since they obtain namely a dense structure and are free of porosity and, in addition, a good mold filling capacity is attained.

The gas scavenging lances have flush heads of porous materials. Since the lances are exposed to the high temperatures of the metal melts, their useful life is naturally short. This also applies to gas scavenging lances with flush heads of porous graphite although graphite is a temperature-stable material and the lance tube can also be made of graphite. The durability of graphite lances is, however, still limited since the graphite burns out after insertion in the melt as a result of the atmospheric oxygen.

SUMMARY OF THE INVENTION

The invention is based on the objective of improving the durability of such graphite lances in preventing this burning out of the graphite after insertion in the melt.

A process for increasing the useful life of gas scavenging lances with porous graphite flush heads for non-ferrous metal melts was now found in which according to the invention an inert gas flows, immediately after scavenging, through the lance in a de-energizing cage which surrounds the graphite parts of the lance while making a narrow gap therewith until a temperature below the ignition temperature of graphite is obtained.

Nitrogen is preferred as the inert gas to flow through the lance for the purpose of cooling. The de-energizing cage to implement the process according to the invention preferably consists of two half shells which conform while forming a narrow gap to the shape of the graphite parts of the lance. The gap should be kept as narrow as possible since higher gas speeds are then attained as a result of which the lance cools more rapidly. The half shells can be flexibly connected with each other by means of a hinge and can be latched when folded together. This makes an especially quick placing of the lance in the de-energizing cage possible after insertion in the melt. In an advantageous embodiment of the invention, the de-energizing cage is removably installed on the bottle cart on which the gas bottle with the scavenging gas is transported so that a homogeneous operating device is obtained.

THE DRAWINGS

DETAILED DESCRIPTION

Figure 1:
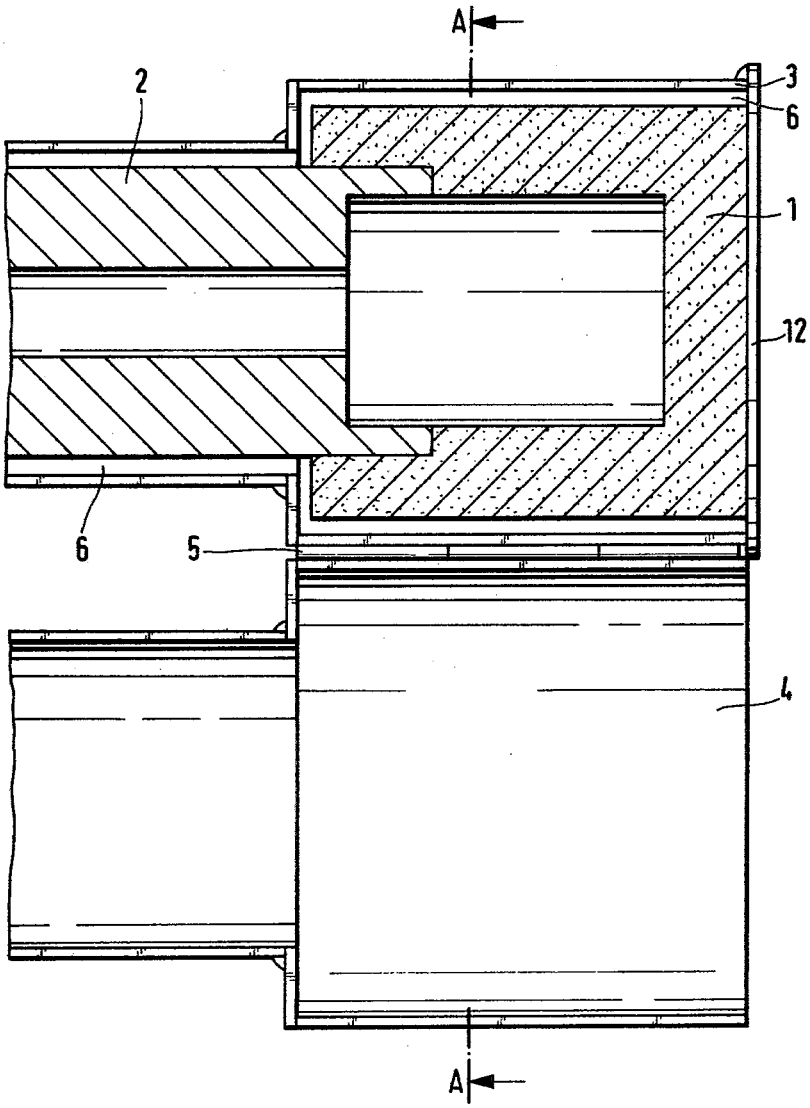
FIG. 1 is a cross-sectional view through a flush head and a part of the connected lance tube, surrounded by a de-energizing cage in accordance with this invention.
Figure 2:
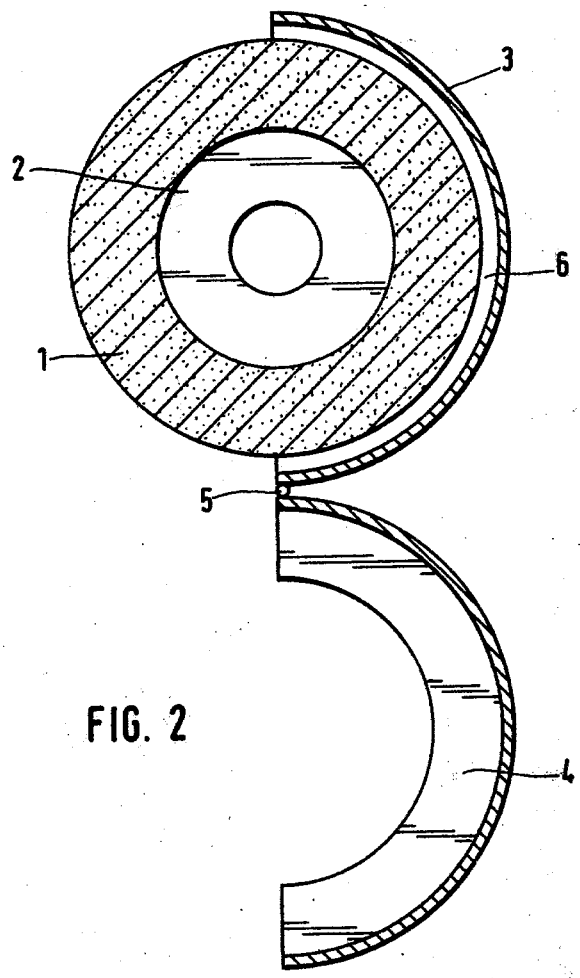
FIG. 2 is a cross-sectional view along line A—A in FIG. 1.

FIG. 1 shows the porous graphite flush head 1 of a gas scavenging lance. The flush head 1 is attached to the lance tube 2 which preferably is also made of graphite. The flush head 1 and the lance tube 2 are surrounded by a de-energizing cage according to the invention, which consists of two half shells 3, 4. The hald shells 3, 4 are flexibly connected by means of a hinge 5. A plate 12 is welded to the half shell 3, which represents in closed condition the floor of the cage. The half shells 3, 4 are shaped in such a way that they surround, while forming a narrow gap 6 in closed condition, the flush head 1 and the lance tube 2 and form in this way the de-energizing cage. FIG. 2 shows the device in cross section.

Figure 3:
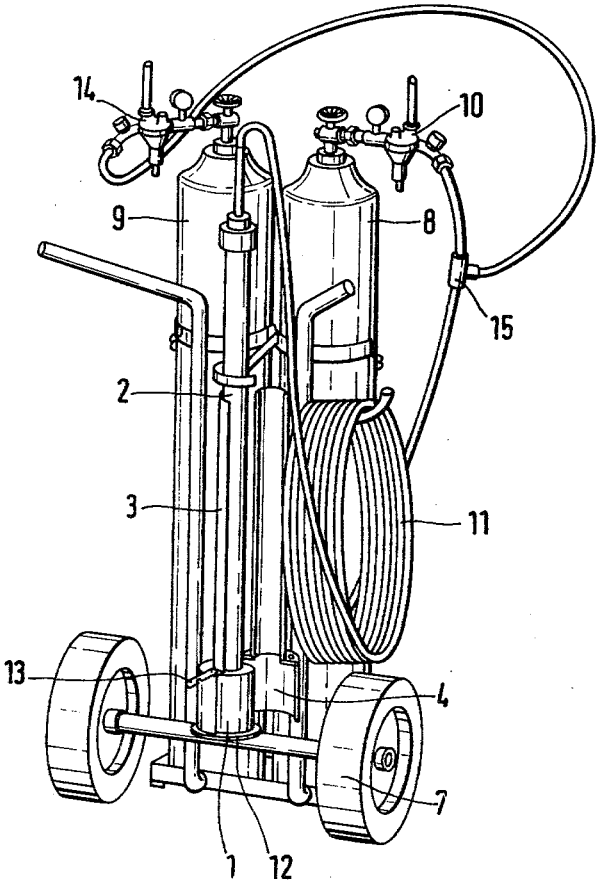
FIG. 3 shows the lance with the de-energizing cage according to FIGS. 1 and 2 installed on a bottle cart.

FIG. 3 shows the device of FIGS. 1 and 2 removably installed by means of a screw connection on a bottle cart 7. The pressure gas bottle 8 is fastened to the bottle cart 7, which contains the scavenging gas for the metal melt, for example, argon. A second pressure gas bottle 9 is, furthermore, provided which contains the nitrogen for cooling and de-energizing the lance.

During operation, the argon flows from the bottle 8 via the pressure reducer with the flow meter 10, the pressure gas hose 11 and the lance tube 2 and the flush head 1 into the metal melt, for example, aluminum. After insertion of the gas scavenging lance in the melt, it is quickly placed on the plate 12 and in the half shell 3. Then the half shell 4 is folded on the half shell 3 and both half shells are firmly connected with each other by means of latch 13.

The argon supply is now interrupted and instead the nitrogen supply for cooling and de-energizing is released.

The nitrogen flows from the pressure gas bottle 9 via the pressure reducer with the flow meter 14 and the T-piece 15 in the pressure gas hose 11. Then it exits from the flush head 1 through the narrow gap 6 along the lance tube 2. Access of atmospheric oxygen to the graphite is prevented as a result and burning out of the graphite is prevented. At the same time, the flush head 1 and the lance tube 2 are rapidly cooled by the high gas speed in the narrow gap 6 so that a temperature below the ignition temperature of graphite is soon obtained. Then the inert gas supply is interrupted and the lance can be taken from the de-energizing cage without danger. As a result of the rapid cooling of flush head 1 and lance tube 2, inert gas consumption is small.

What is claimed is:

1. In a process for increasing the useful life of gas scavenging lances having porous graphite flush heads for non-ferrous metal melts, the improvement being flowing an inert gas, immediately after scavenging, through the lance in a de-energizing cage which surrounds the graphite parts of the lance while forming a narrow gap therewith until a temperature below the ignition temperature of graphite is obtained.

2. In a process characterized by the use of the same lance passage for feeding both the scavenging gas and the cooling gas and for increasing the useful life of gas scavenging lances having porous graphite flush heads for nonferrous melts wherein the scavening lance is lowered into the crucible containing the non-ferrous melt and a scavenging gas is flowed through the feed passage in the lance and exits through the flush head into the melt for scavenging the melt, the improvement being discontinuing the flowing of the scavenging gas and immediately thereafter inserting the lance in an openable de-energizing cage by closing the cage around the lance wherein the cage conforms in shape to and surrounds the graphite parts of the lance and is spaced therefrom by a narrow gap which communicates with the same feed passage and which is closed at its other end thereof, and then flowing an inert cooling gas through the same feed passage in the lance and then exiting the cooling gas from the lance into the narrow gap until a temperature below the ignition temperature of graphite is obtained.

3. In the process of claim 2, characterized in that the lance is placed against an end plate when it is inserted into the de-energizing cage to close the gap by the end plate.

4. In the process of claim 2, characterized in that the de-energizing cage comprises a pair of hinged half shells, and the lance is inserted into the de-energizing cage when the half shells are in their open condition, and the half shells are then hinged closed around the lance.

* * * * *